US005493836A

United States Patent [19]

Lopez-Muñoz

[11] Patent Number: 5,493,836

[45] Date of Patent: Feb. 27, 1996

[54] BUILDING SYSTEM BASED UPON PREFORMED MODULES

[76] Inventor: Humberto Lopez-Muñoz, Av. Junco de la Vega #208, Col. Ruma 64700, Monterrey, Neuvo Leon, Mexico

[21] Appl. No.: 169,623

[22] Filed: Dec. 20, 1993

[51] Int. Cl.[6] ..... E04B 2/00

[52] U.S. Cl. ..... 52/602; 52/270; 52/250; 52/309.11; 52/583.1; 52/582.1; 52/601

[58] Field of Search ..... 52/583.1, 587.1, 52/309.11, 309.12, 309.8, 250, 601, 602, 405.1, 582.1, 583.1, 270, 271

[56] References Cited

U.S. PATENT DOCUMENTS

| | | | |
|---|---|---|---|
| 1,353,702 | 9/1920 | Aschauer | 52/602 X |
| 1,375,103 | 4/1921 | Needham | 52/602 X |
| 1,477,665 | 12/1923 | Richman | 52/602 X |
| 2,753,962 | 7/1956 | McBerty | 52/250 |
| 3,381,483 | 5/1968 | Huthsing, Jr. | 52/601 X |
| 3,435,581 | 4/1969 | Ahlqvist | 52/405.1 |
| 3,555,763 | 1/1971 | Bloxom | 52/601 X |
| 3,826,051 | 7/1974 | Miller et al. | 52/583.1 X |
| 3,848,381 | 11/1974 | Bloxom | 52/601 X |
| 3,851,428 | 12/1974 | Shuart | 52/583.1 X |
| 4,037,381 | 7/1977 | Charles | 52/601 X |
| 4,052,831 | 10/1977 | Roberts et al. | 52/309.8 |
| 4,206,267 | 6/1980 | Jungbluth | 52/309.8 X |
| 4,274,239 | 6/1981 | Carroll | 52/309.8 X |
| 4,472,919 | 9/1984 | Nourse | 52/601 |
| 4,554,124 | 11/1985 | Sudrabin | 52/601 X |
| 5,055,252 | 10/1991 | Zimmerman | 52/309.12 X |
| 5,088,259 | 2/1992 | Myers | 52/309.8 X |
| 5,335,472 | 8/1994 | Phillips | 52/309.12 X |

*Primary Examiner*—Wynn E. Wood
*Attorney, Agent, or Firm*—Laurence R. Brown

[57] ABSTRACT

This invention refers to an improved modular system for housing based upon preformed reinforced concrete modules (ferro-cement). Different modules provide for fast and simple interconnection to form housing sets from interlinked sets of welded together modules.

8 Claims, 12 Drawing Sheets

BUILDING SYSTEM BASED UPON PREFORMED MODULES

This invention refers to an improved system for housing construction and like projects, based upon preformed modules of reinforced concrete (ferro-cement), and the possibility of rapid construction resulting from simple structure, interconnection and strengthen features. Various modules may be formed into different kinds of structural sets.

INVENTION BACKGROUND

Currently in some construction projects, particularly in low income housing projects, there has been a growing use of reinforced concrete modules. Modules are featured to produce construction time savings. However long construction times occur due to the complexity of ferro-cement module structures, excessive weights and the need for extensive workmanship and labor during placement, interconnection and finishing. A further deficiency is the lack of thermal characteristics that protect the house from any external extreme ambient conditions.

In order to overcome inconveniences and complications in housing projects, a series of modules was developed along with a construction system based on these modules, in accordance with this invention, which therefore provides an improved method for building houses with good thermal characteristics.

BRIEF DESCRIPTION OF THE DRAWINGS

As generally set forth in perspective view:

FIG. No. 1 Partly broken away, shows parts which form a module.

Figure 1:
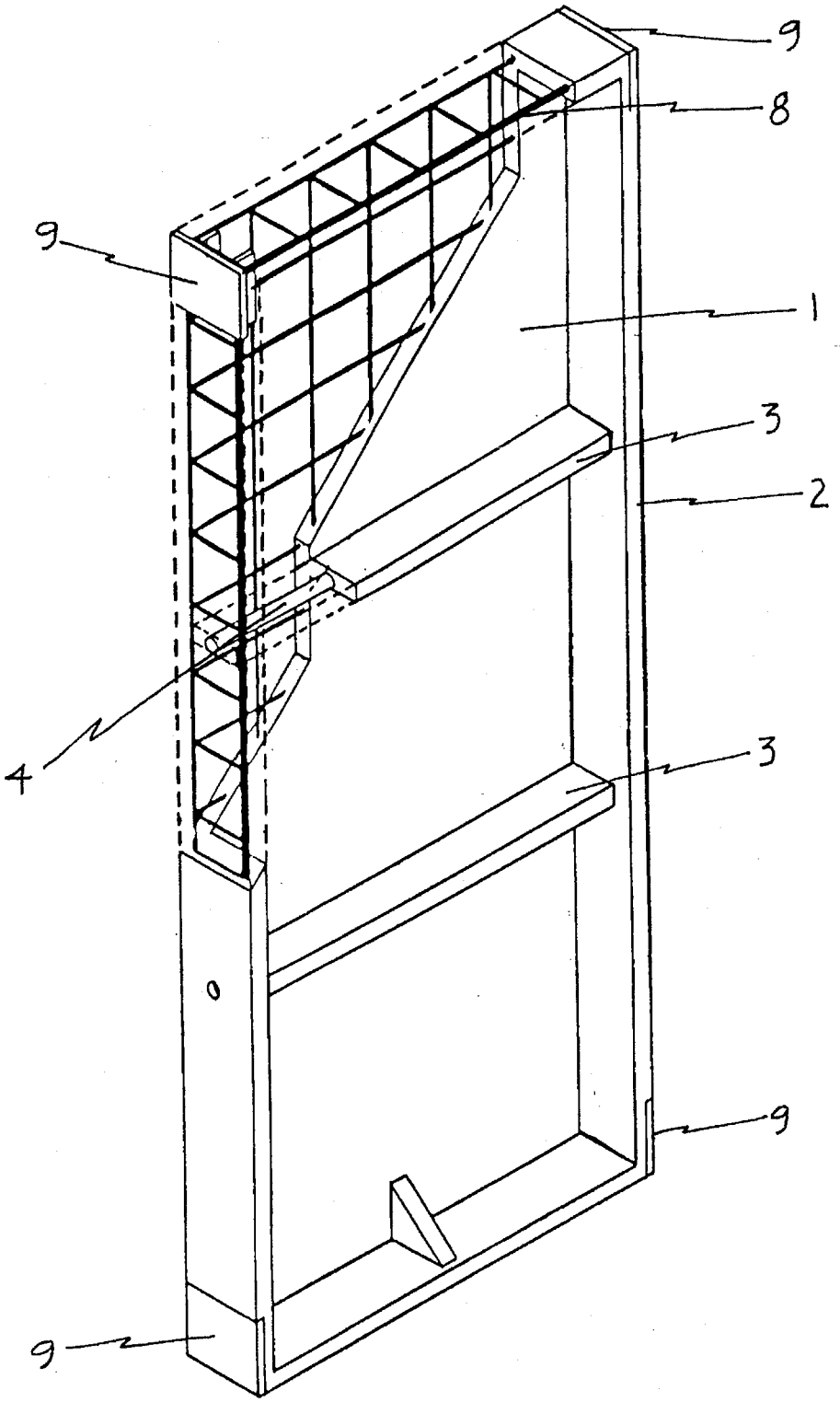
Figure 2:
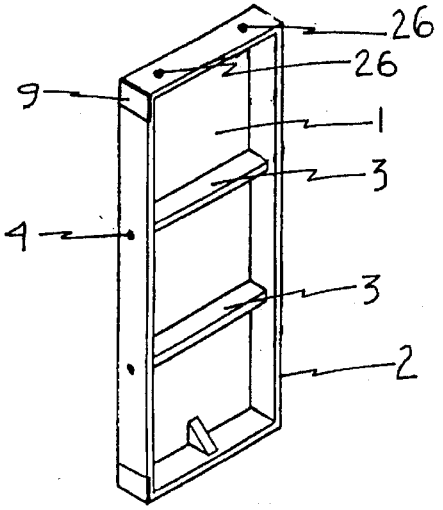
Figure 3:
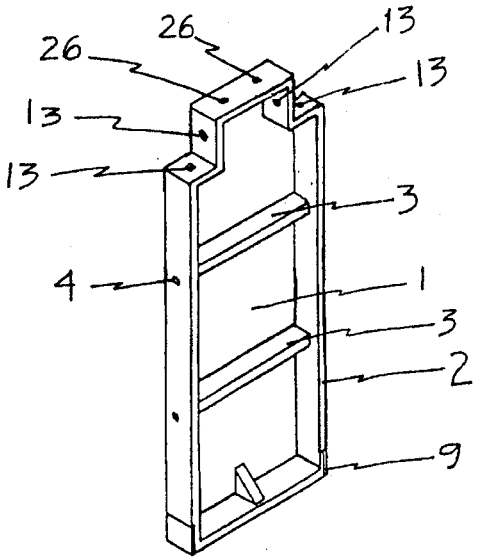
Figure 4:
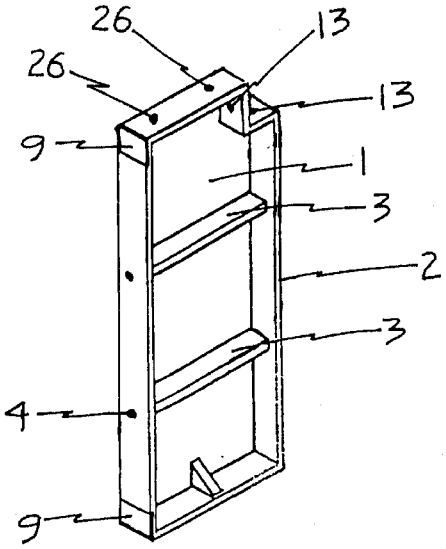
Figure 5:
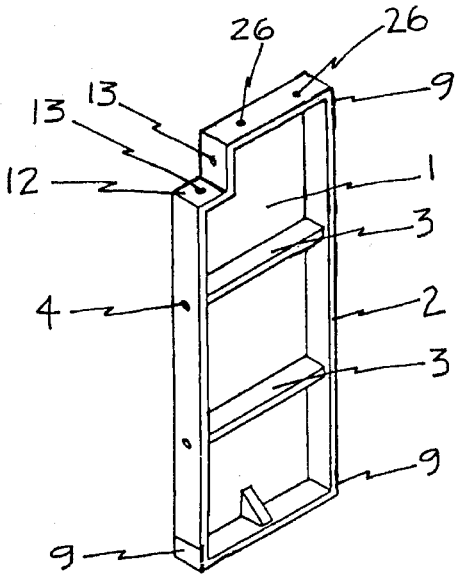
Figure 6:
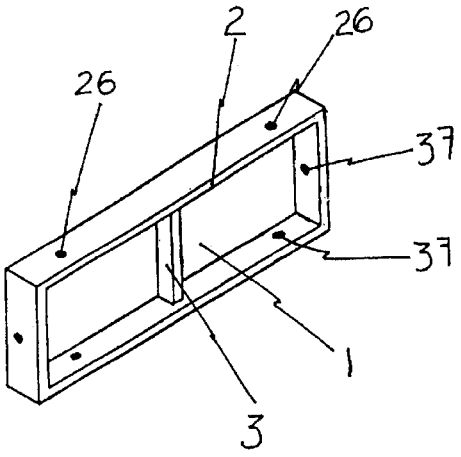
Figure 7:
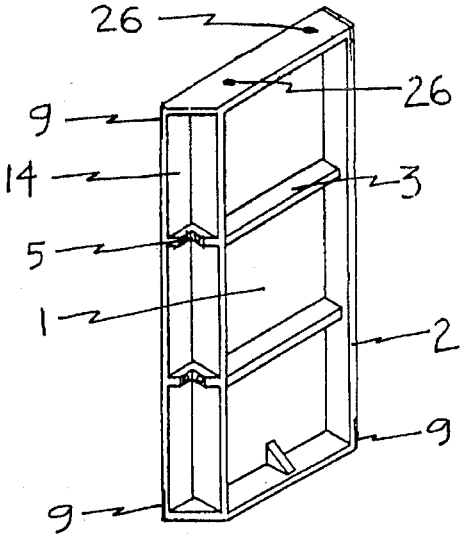
Figure 8:
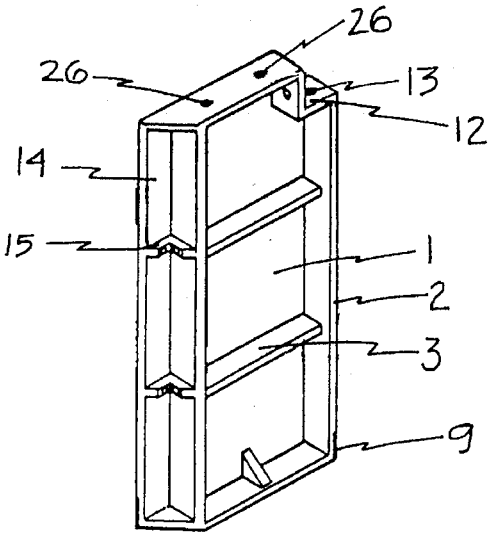
Figure 9:
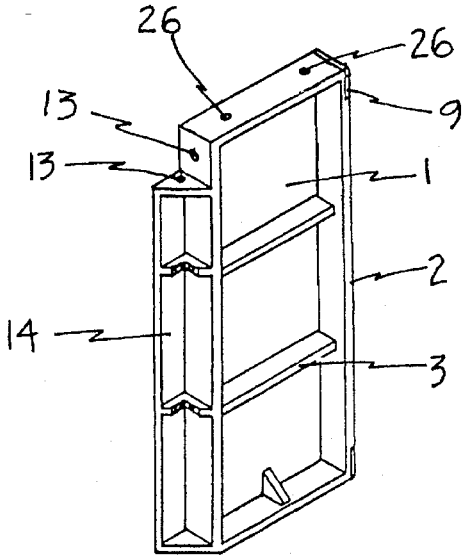
Figure 10:
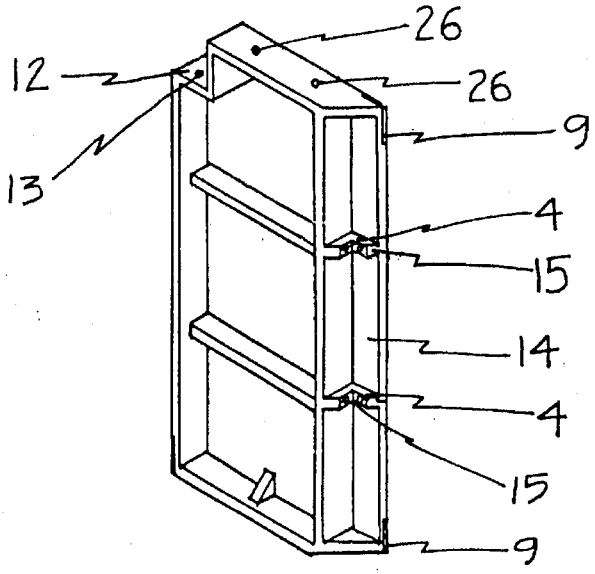
Figure 11:
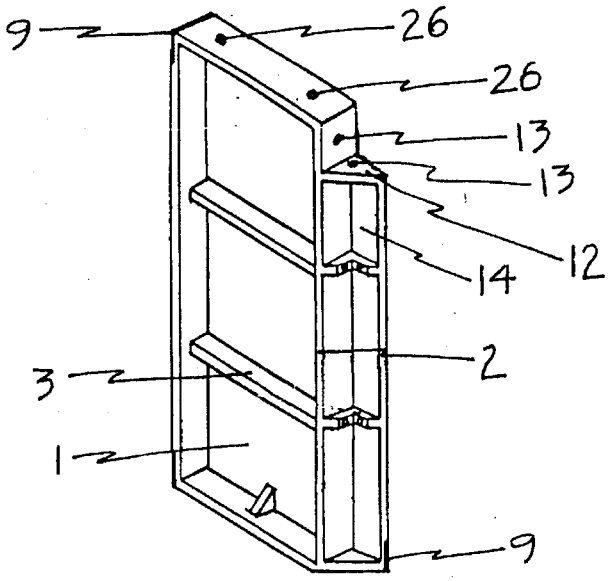
Figure 12:
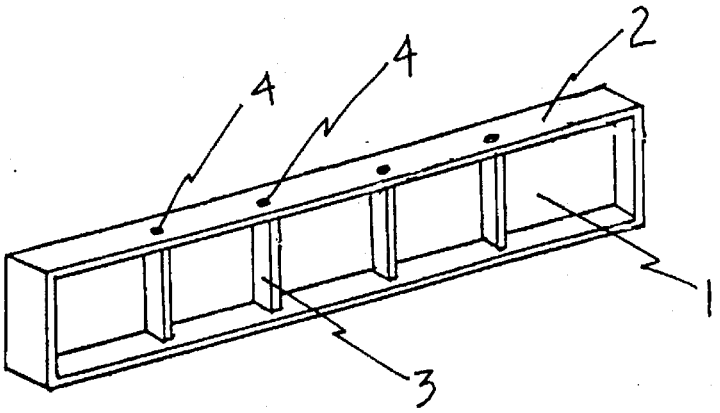
Figure 13:
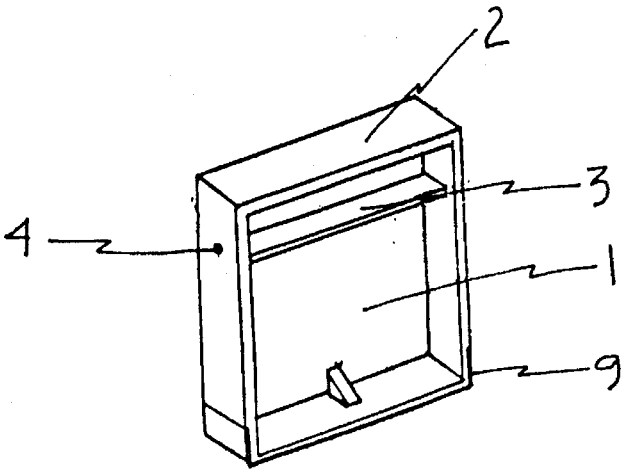

FIG. No. 2 Shows a normal module (hereafter: A).

FIG. No. 3 Shows a double supported module (hereafter: B) .

FIG. No. 4 Shows a right side—supported module (hereafter: C).

FIG. No. 5 Shows a left side—supported module (hereafter: D).

FIG. No. 6 Shows a bracing—girder (hereafter: E).

FIG. No. 7 Shows a corner module (hereafter: F).

FIG. No. 8 Shows a left corner—module with right side support (hereafter: G).

FIG. No. 9 Shows a left corner—module with left side support (hereafter: H).

FIG. No. 10 Shows a right corner module with left side support (hereafter: I).

FIG. No. 11 Shows a right corner module with right side support (hereafter: J).

FIG. No. 12 Shows a slab module—(hereafter: K).

FIG. No. 13 Shows a window module (hereafter: L).

FIG. No. 14 Shows module set partly in section, with: foundation, ground slab, retention trough, and anchors in engaged position.

FIG. No. 15 Shows a module set with connector bolt and nuts.

FIG. No. 16 Shows a module set with connector bolts and nuts and supporting walls.

FIG. No. 17 Shows partly in section a structural joint with connector and nut, frame, backing, rib, and metal conduit rod.

FIG. No. 18 Shows a fragmental view of a joint between modules, with anchors, metal plates and panels in place.

FIG. No. 19 Shows a fragment of a panel structural section.

FIG. No. 20 Shows a module set, including structural connectors, metal frame for electrical outlets, service pipes and plates.

FIG. No. 21 Shows a module arrangement, with connections, panels and piping outlet such as used in a house.

As illustrated by these figures, the construction system of this invention is characterized by a combination of preformed ferro-cement modules (FIGS. 1–13). The modules are formed with a pack panel (1), about whose borders frame members protrude perpendicularly (2) and several transverse ribs (3) which form the module. In a rib interior is a metal conduit rod (4) through which a structural connector bolt (5) penetrates for its linkage to other modules.

Figure 14:
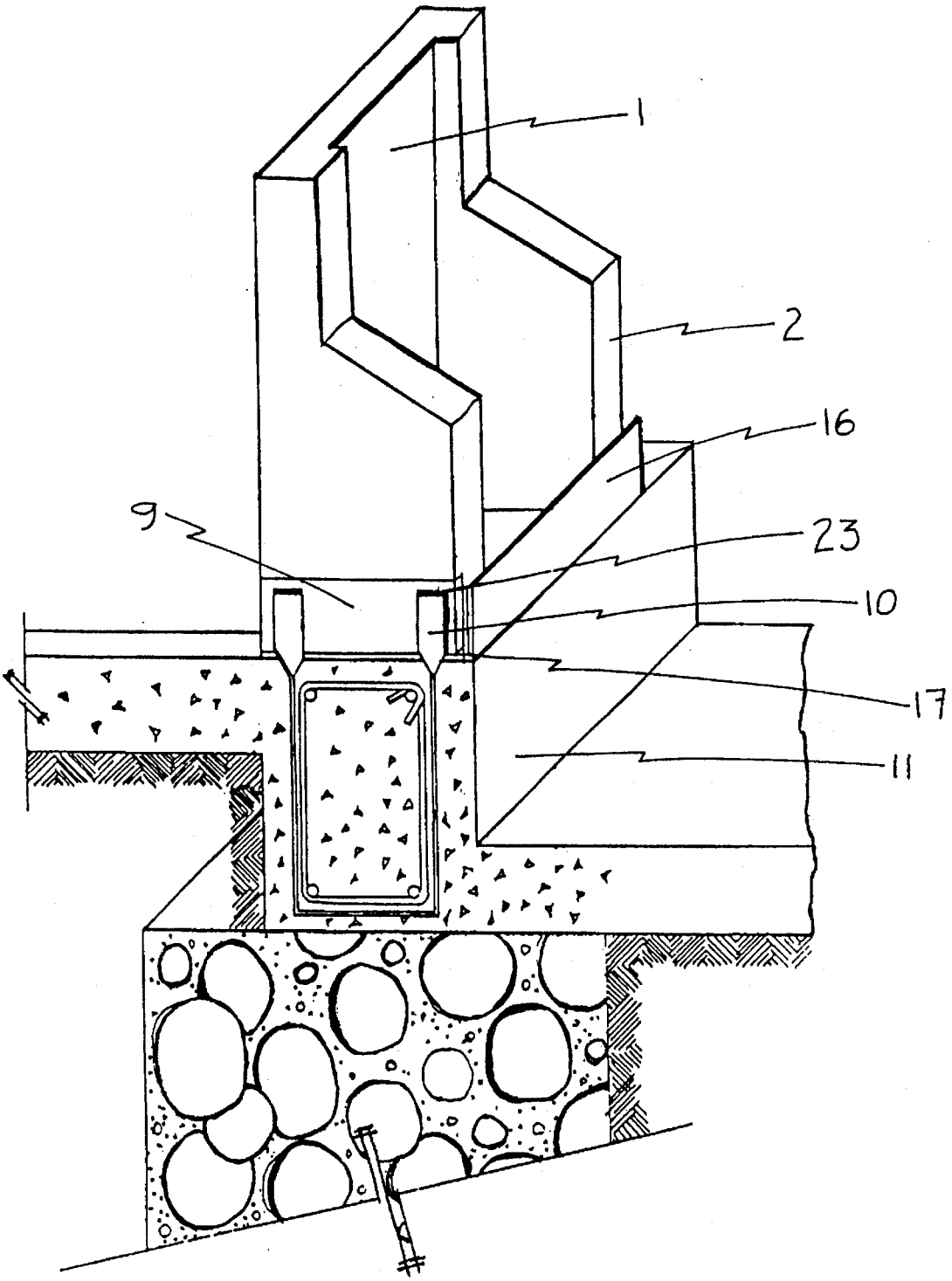
Figure 19:
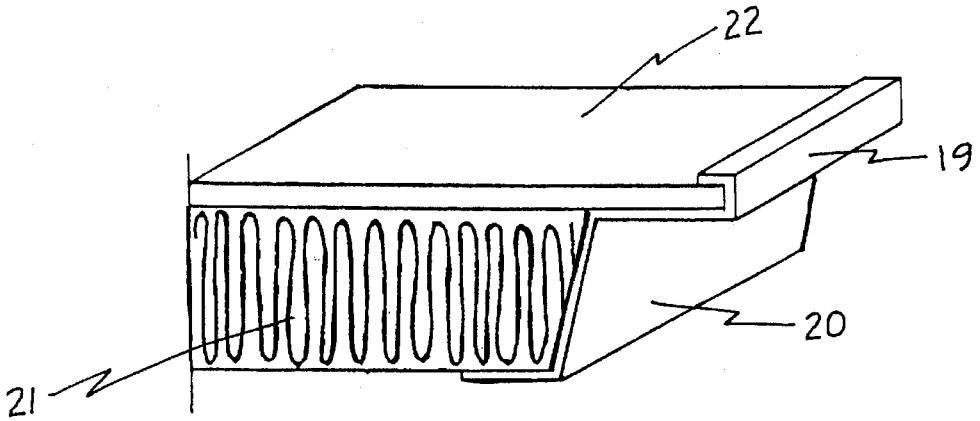

Light reinforced concrete (ferro-cement) structure (8) keeps the form of the modules. Embedded in each corner of the reinforced concrete structure (8) is an integrated metal plate (9) firmly joined to the reinforced corner structure (8), as shown on the sides of the frame (2). Anchors (10) (FIG. 14) are welded to the metal outlet frames (19) (FIG. 19) or other metal plates (9) of the adjacent modules.

The normal modules (A, FIG. No. 2) are characterized by an irregular backing.

Figure 15:
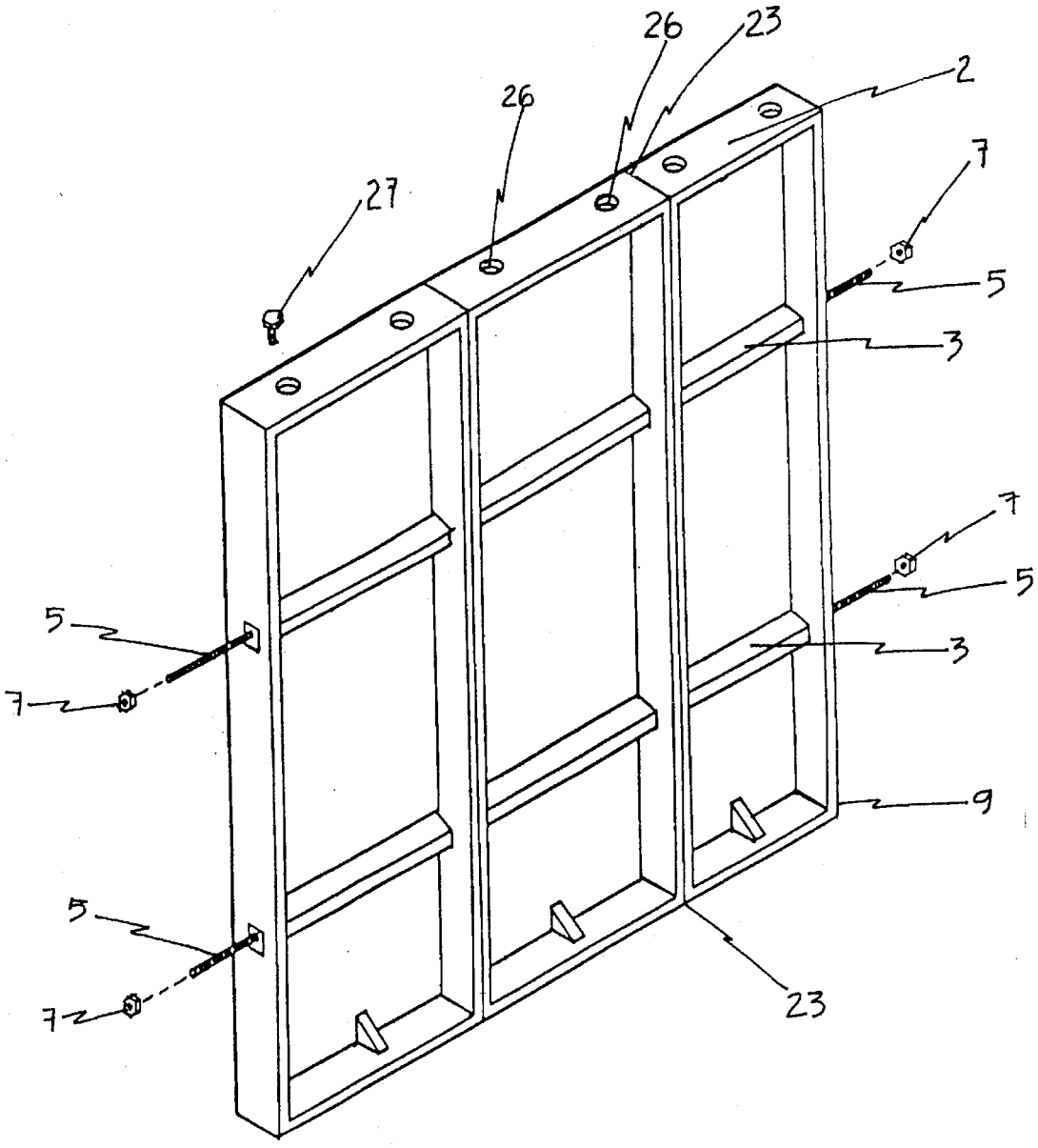
Figure 16:
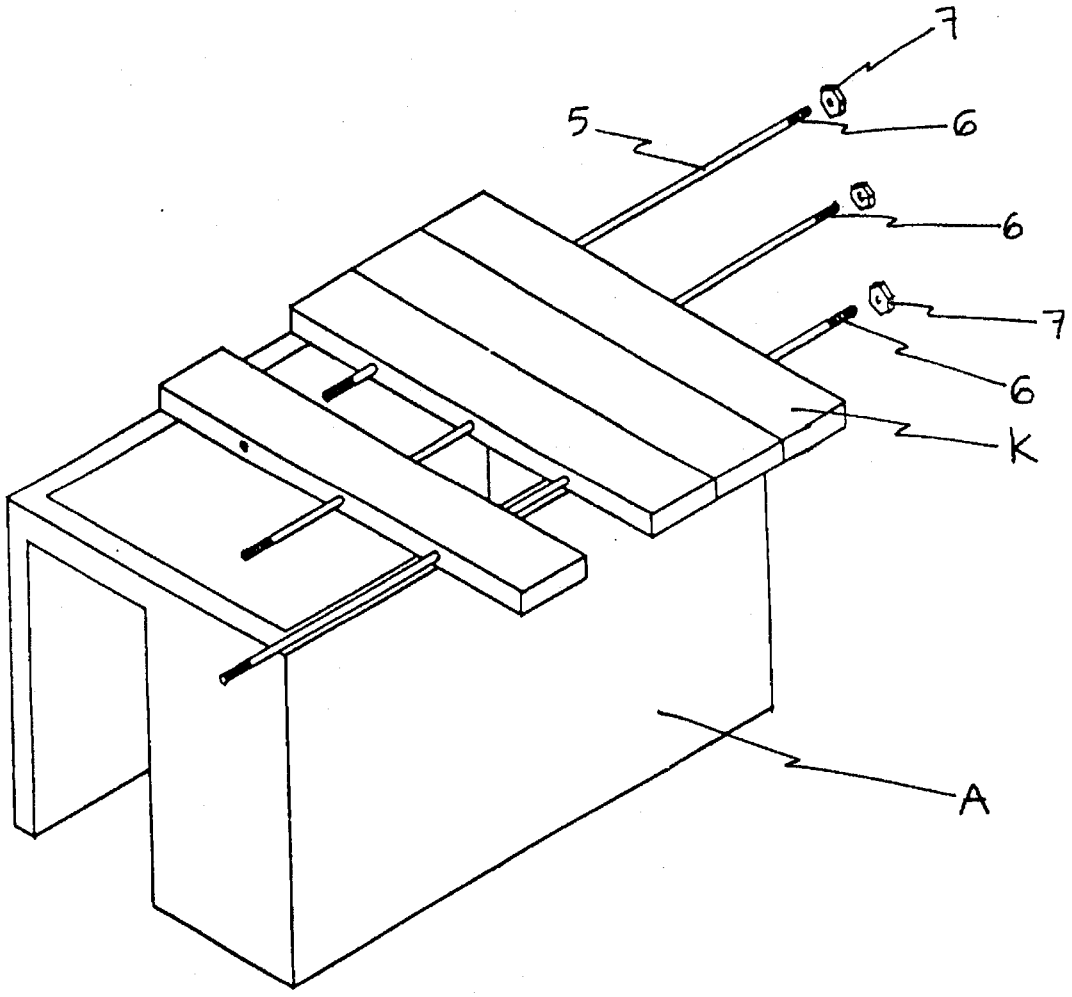
Figure 17:
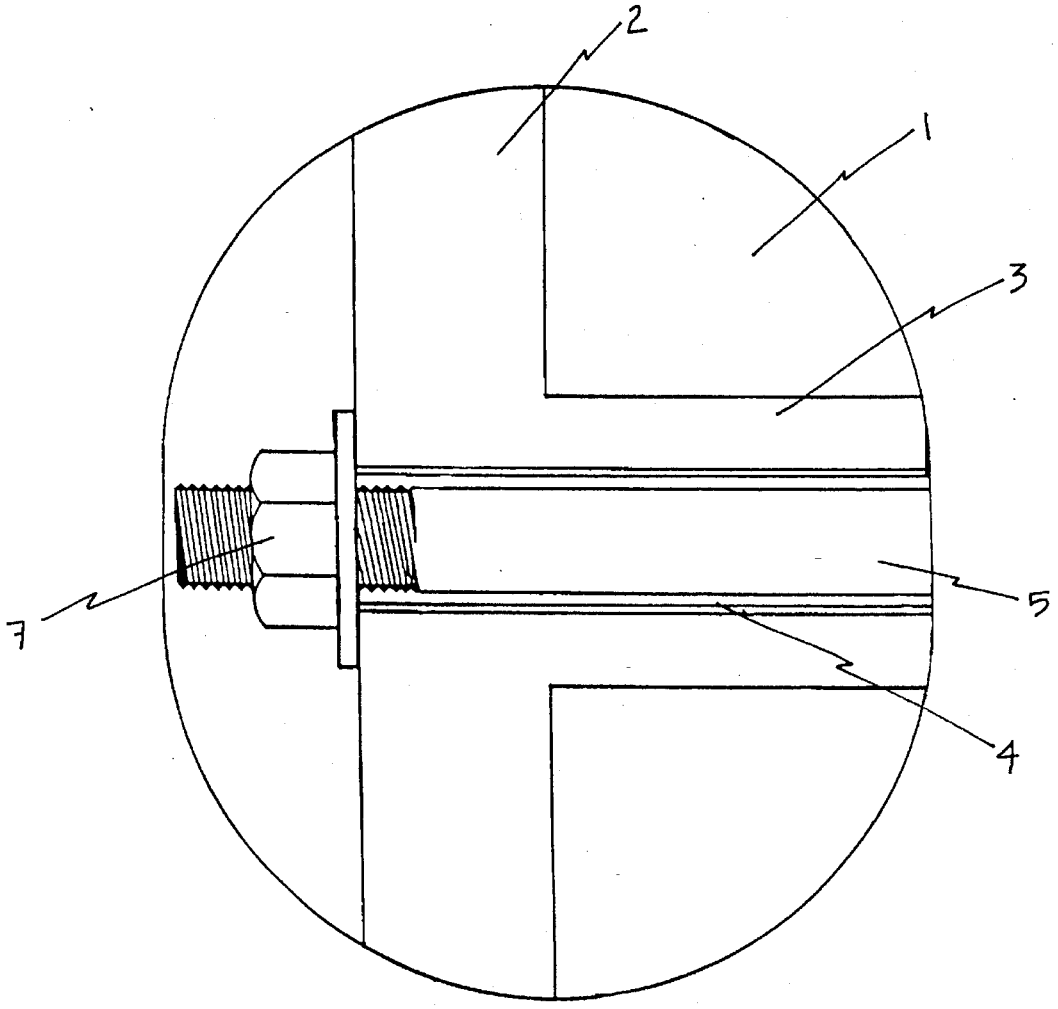

The support modules (B, C, D, FIG. No. 3–5) are characterized by a squared support (12) in one or several upper groins, where there will be holes (13) for connection bolts (27) (FIG. 15).

The corner modules (F, FIG. No. 7) are characterized by a reinforced protuberance (14) colinear to the back plane (1). Along the protuberances there will be holes (15) (FIGS. 10, 11) for overlapping with the metal conduits (4) of the module perpendicular to this protuberance (14) for allowing structural connectors (5) to pass through them.

The side supported corner modules (G, H, I, and J, FIGS. 8, 9, 10, 11) are characterized by the combination of a reinforced protuberance (14), colinear to the back plane (1) on one of its sides, which will have holes (15), additionally having one or two perpendicular supports (12) in its upper groins.

The bracing girder (E, FIG. No. 6) is characterized by a rectangular elongated backing (1), with a frame (2), with transverse ribs (3), lacking metal conduits and having holes (26) on its ends for joining to the side supported modules (FIG. No. 3, 8–11), by means of bolts (27) (FIG. 15).

The slab modules (K, FIG. No. 12) are characterized by a rectangular elongated backing (1), with a frame (2), with transverse ribs (3), having a conduit (4), longitudinal by passing through them.

The window module (L, FIG. No. 13) is an element whose frame (2) borders the backing (1) and is reinforced with transverse ribs (3). It also is characterized due to its form, which when mounted between the side supported modules (B, C, D, G, H, I, J, FIG. Nos. 3, 4, 5, 8–11) form a window.

The structural connector (5) (FIG. 15) is characterized by a slim body that allows its introduction through the metal conduits (4) and has threaded ends (6) to screw on nuts (7).

The anchors are made of sheet steel, embedded along the foundations, (11, FIG. No. 14), spaced at intervals coinciding with the sides of the frame (2) allowing its union to the metal plate (9) by means of arc welding.

Figure 18:
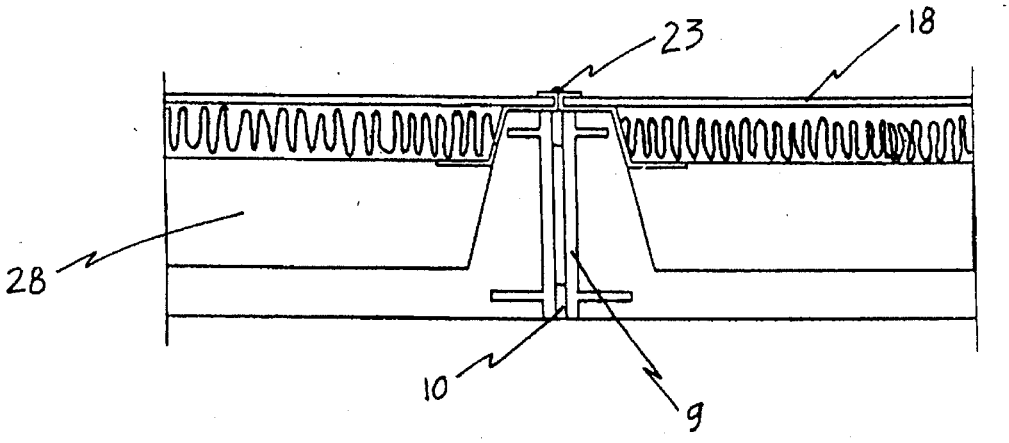
Figure 20:
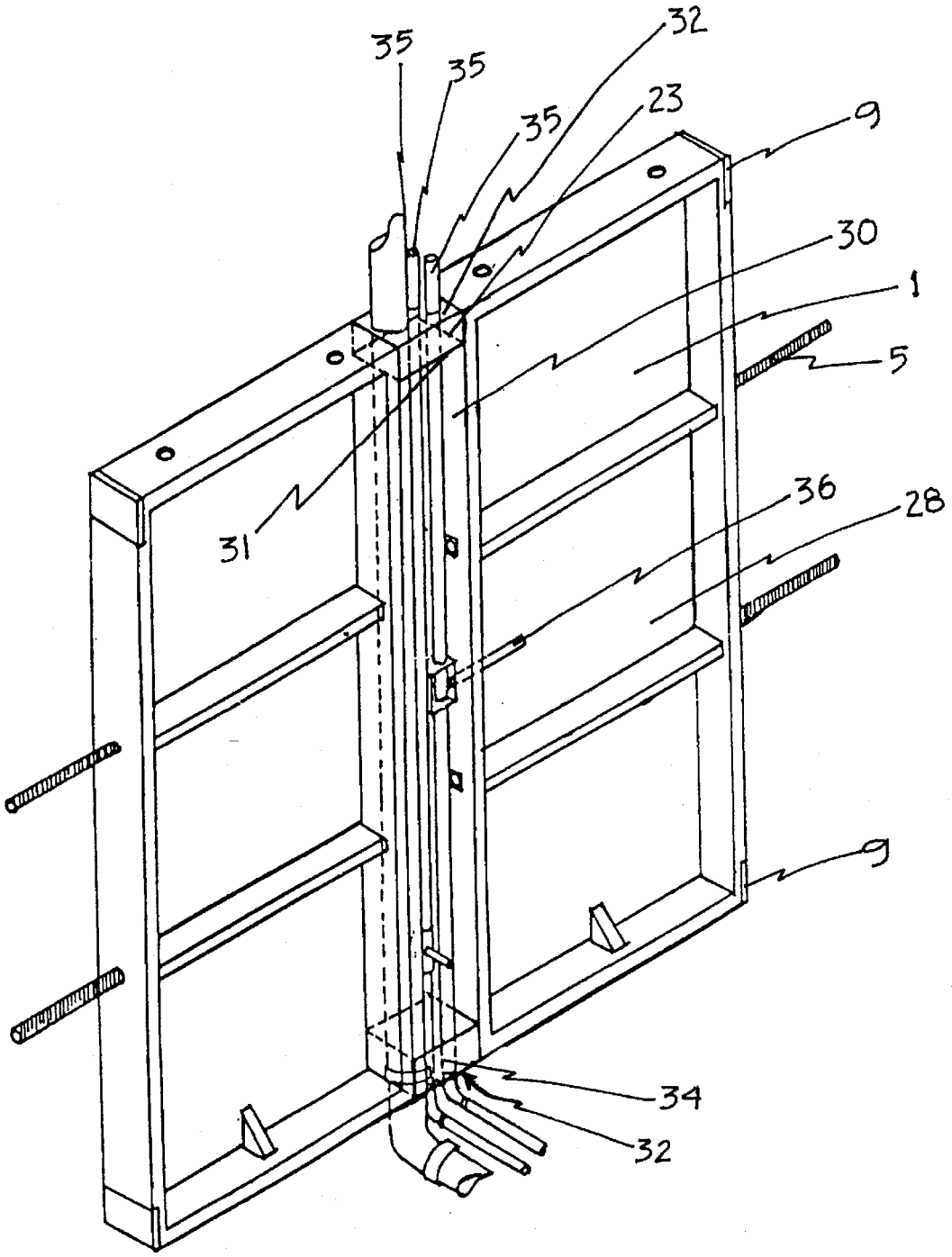
Figure 21:
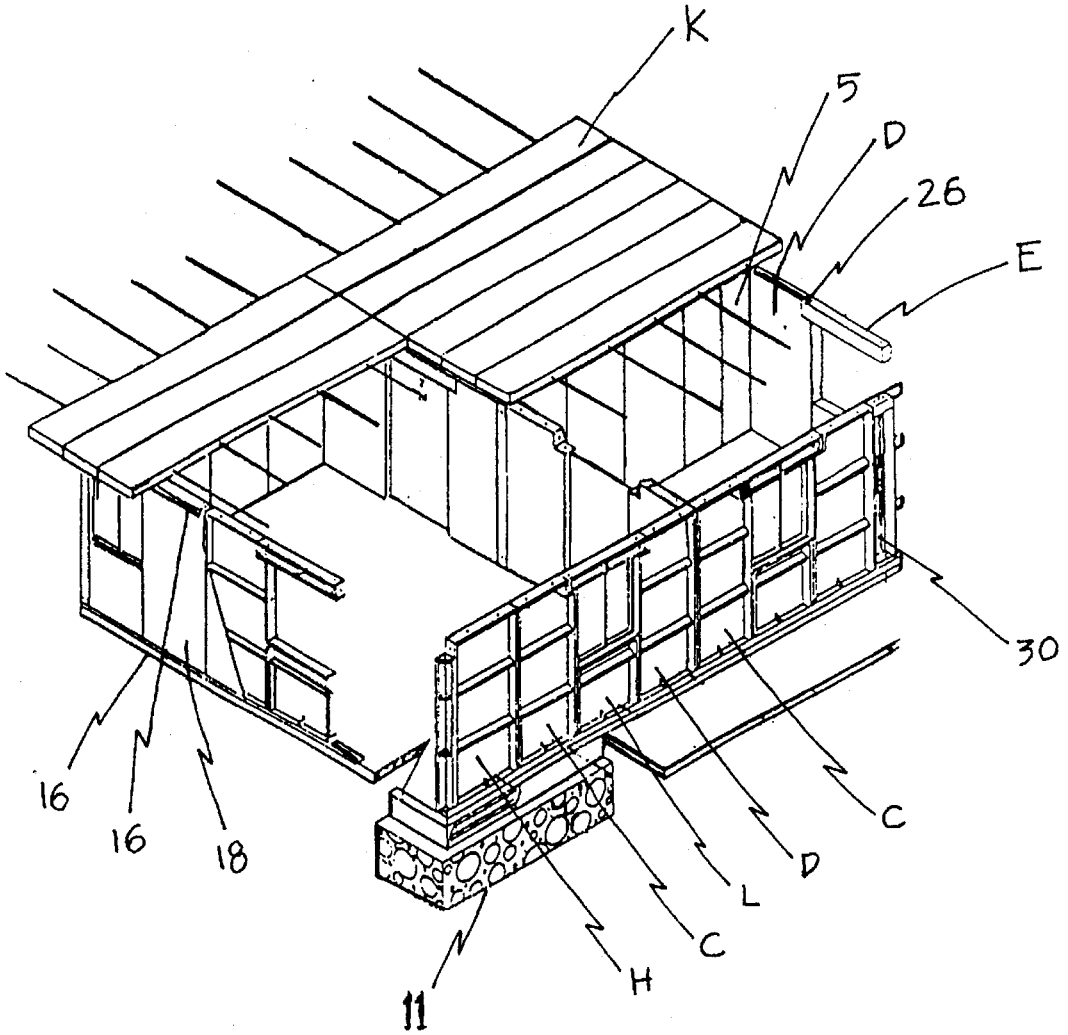

The metal outlet frames (FIG. 20), are characterized by their box shaped channel to allow passage of service piping 35 and metal frame (31) to affix it to metal plates (9). In the visible face (32) of frame (3), there are threaded holes (34) for the further affixing of a panel plate (18) (FIGS. 18, 21) with bolts (27) (FIG. 15).

The panels (FIG. 19) are characterized by the combination of a rigid cover (22) which can be made of fiber cement, a metal gird (20), perforated at its ends and an insulation material (21), foamed in a way such that it becomes integrated as shown in FIG. No. 18 and 19.

The retention trough 16 (FIG. 14) consists of a metal angle of a length the same as the base of the module.

When it is desired to build walls, the foundations will be cast in the traditional form, designed to support half of the usual weight, since these modules lighten construction in that proportion. The anchors (10) will be left embedded at the required intervals, as well as the service piping.

Further, when the cement is cured, the retention troughs (16) are to be located on the foundations (11), aligned and welded to the anchors (10). Then the module placement will be continued, beginning in some corner where they will be overlapped on the retention trough (16) and once aligned and straightened they will be welded to the anchors (10), in such a way that the retention trough (16) is separated from the frame (2) and forms a cavity (17) where the base of the panel (18) (FIG. 19) will later be located. These corners will be formed when joining a corner module (FIG. No. 7–11) with a normal module (FIG. No. 1). The operation of joining the modules will continue to complete a wall, leaving spaces for doors and windows. For example, if a door is wanted, simply leave a space within two side supported modules (FIG. No. 3, 4, 5, 8–11) placing above them a squared support (12) and a bracing girder (FIG. No. 6).

In the case of a window, it is only necessary to place one or more window modules (FIG. No. 13) between two side support modules (FIG. No. 3, 4, 5, 8–11) as required and in the upper part as transom. A bracing girder module (FIG. No. 6) will be used and affixed by bolts (27) that pass through its holes (37) matching the support holes (13) of the perpendicular support (12).

As the modules are joined together, they are welded in place by the anchors (10) and the metal plates (9) to maintain the vertical position and alignment of the modules. The operation is continued until completing the wall. Then the structural connectors (5) will be introduced through the conduits (4), transversally passing through the walls as shown in FIG. No. 15. Once this is done, the structural connector's threaded ends (5) have nuts (7) turned to tighten and join the modules.

The metal frames for outlets are placed between modules in the adequate places welding their frame (32) to metal plates (9) of the adjacent modules, as can be seen in FIG. No. 20, providing a cavity (30) where the main service piping (35) will be accommodated. Secondary pipings (36) will come from and through the cavities (28) of the modules.

Once this is done, panels (18) are mounted to close the cavities (28) of each of the types of modules, in such a way that when covering two neighboring modules, the borders (19) of the panels are joined and allowed to be linked by means of small welded joints (23). Besides being linked in their horizontal sides by the retention troughs (16), the upper ends are screwed to the holes (26) of the upper part of the module and the metal outlet frames are covered with the corresponding panel (18) which is bolted to the metal frame (31) on both sides to hide the service piping (35).

For the placement of the roof, the ends of the slab modules (FIG. No. 12) and supported as seen in FIG. No. 21 over the walls and are joined together until covering the clearance between them, in a way that their cavities (28) are looking downward and their conduits (4) are coaxial to join them with structural connectors (5), as shown in FIG. No. 16 and 21. Once the clearances are covered, the slabs are bolted (7) and tightened for a firm intermodular union.

Once this is done, the secondary piping and electric outlets are located, connected, and affixed over the slab modules (FIG. No. 12) for later doing a plastering over them, to hide the pipes and provide for a slope for waterfall.

What is claimed is:

1. A preformed reinforced concrete building module comprising in combination:

a rectangular shaped reinforced concrete panel having integral concrete border framework ridges about the panel extending perpendicular to the reinforced concrete panel thereby leaving an empty void space as deep as the framework ridges within the framework ridges, said ridges presenting at least four substantially outermost rectangular corners having a metal corner plate integrally embedded therein said corners, said corner plates being located only at said outermost corners thus providing an outermost member unitarily interconnecting side-by-side panels into sets by welding of the corner plates.

2. The module of claim 1 further comprising transverse concrete ribs extending perpendicular to the reinforced concrete panel between opposing framework ridges.

3. The module of claim 2 further comprising cylindrical metal conduits extending inside the ribs and through the framework ridges for reception of a connector bolt.

4. The module of claim 1 forming with at least one similar adjacent module a wall with adjacent modules connected together by welded joints at adjoining said plates on side-by-side modules.

5. The module of claim 1 further comprising a metal configuration adhered to said metal plates forming an enclosure adjacent said concrete panel ridges and having insulation material contained in said enclosure.

6. The module of claim 1 having attached on a vertically disposed side of the reinforced concrete panel by welding to said plates a metal enclosure for passing pipes upwardly in a wall formed by said panels.

7. The module of claim 1 further comprising said rectangular shaped panel adapted to be vertically placed into a wall with at least one uppermost corner indented to form a rectangular notch.

8. The module of claim 1 further comprising a corner module having an integral triangular shaped cornerpiece extending from a vertically disposed framework ridge of the panel.

* * * * *